US007489225B2

(12) United States Patent
Dadafshar

(10) Patent No.: US 7,489,225 B2
(45) Date of Patent: Feb. 10, 2009

(54) PRECISION INDUCTIVE DEVICES AND METHODS

(75) Inventor: Majid Dadafshar, Escondido, CA (US)

(73) Assignee: Pulse Engineering, Inc., San Diego, CA (US)

( * ) Notice: Subject to any disclaimer, the term of this patent is extended or adjusted under 35 U.S.C. 154(b) by 0 days.

(21) Appl. No.: 10/990,915

(22) Filed: Nov. 16, 2004

(65) Prior Publication Data

US 2005/0151614 A1 Jul. 14, 2005

Related U.S. Application Data

(60) Provisional application No. 60/520,965, filed on Nov. 17, 2003.

(51) Int. Cl.
*H01F 27/28* (2006.01)

(52) U.S. Cl. ..... 336/223

(58) Field of Classification Search ..... 336/223
See application file for complete search history.

(56) References Cited

U.S. PATENT DOCUMENTS

| | | | | |
|---|---|---|---|---|
| 1,767,715 | A | 6/1930 | Stoekle | |
| 2,418,542 | A * | 4/1947 | Camras | 360/66 |
| 3,068,436 | A | 12/1962 | Holmberg et al. | |
| 3,585,553 | A | 6/1971 | Muckelroy et al. | |
| 3,874,075 | A | 4/1975 | Lohse | |
| 4,352,081 | A | 9/1982 | Kijima | |
| 4,424,504 | A | 1/1984 | Mitsui et al. | |
| 4,597,169 | A | 7/1986 | Chamberlin | |
| 4,760,366 | A | 7/1988 | Mitsui | |
| 5,003,279 | A | 3/1991 | Morinaga et al. | |
| 5,351,167 | A | 9/1994 | Wai et al. | |
| 5,440,225 | A * | 8/1995 | Kojima | 323/359 |
| 5,461,555 | A * | 10/1995 | Kitajima et al. | 363/21.16 |
| 5,816,894 | A * | 10/1998 | Hosozawa et al. | 451/28 |
| 6,005,467 | A | 12/1999 | Abramov | |
| 6,087,920 | A | 7/2000 | Abramov | |
| 6,087,921 | A | 7/2000 | Morrison | |
| 6,362,986 | B1 | 3/2002 | Schultz et al. | |
| 6,483,409 | B1 | 11/2002 | Shikama et al. | |
| 6,737,951 | B1 * | 5/2004 | Decristofaro et al. | 336/234 |
| 6,967,553 | B2 * | 11/2005 | Jitaru | 336/178 |
| 2002/0093409 | A1 * | 7/2002 | Fujiwara et al. | 336/178 |
| 2004/0113741 | A1 * | 6/2004 | Li et al. | 336/212 |
| 2004/0207503 | A1 | 10/2004 | Flanders et al. | |

FOREIGN PATENT DOCUMENTS

| | | | |
|---|---|---|---|
| JP | 63136607 | A * | 6/1988 |
| JP | 02025010 | A * | 1/1990 |

* cited by examiner

*Primary Examiner*—Elvin G Enad
*Assistant Examiner*—Joselito Baisa
(74) *Attorney, Agent, or Firm*—Gazdzinski & Associates

(57) ABSTRACT

A low cost, low profile and high performance inductive device for use in, e.g., electronic circuits. In one exemplary embodiment, the device includes a four-legged ferrite core optimized for fitting with four or more windings, thereby providing four close-tolerance inductors. Optionally, the device is also self-leaded, thereby simplifying its installation and mating to a parent device (e.g., PCB). In another embodiment, multiple windings per leg are provided. In yet another embodiment, the device has only to opposed legs, thereby reducing footprint. Methods for manufacturing and utilizing the device are also disclosed.

22 Claims, 16 Drawing Sheets

"EI" VARIANT (WIDE LEADS)

(NARROW LEADS)

PRECISION INDUCTIVE DEVICES AND METHODS

PRIORITY

This application claims priority to U.S. Provisional Application Ser. No. 60/520,965 filed Nov. 17, 2003 of the same title, incorporated herein by reference in its entirety

FIELD OF THE INVENTION

The present invention relates generally to inductive circuit elements and more particularly to inductive devices having various desirable electrical and/or mechanical properties, and methods of operating and manufacturing the same.

DESCRIPTION OF RELATED TECHNOLOGY

Myriad different configurations of inductors and inductive devices are known in the prior art. See, for example, U.S. Pat. No. 1,767,715 to Stoekle, U.S. Pat. No. 3,068,436 to Holmberg, et al, U.S. Pat. No. 3,585,553 to Muckelroy et al., U.S. Pat. No. 3,874,075 to Lohse, which represent various approaches to providing inductances within a circuit.

Still other configurations are known. For example, U.S. Pat. No. 4,352,081 to Kijima issued Sep. 28, 1982 entitled "Compact trans core" discloses a compact core for a transformer wherein the central leg of the core is either trapezoidal or triangular in cross-section and wherein the two side legs of the transformer core are triangular in cross-section. The selection of a trapezoidal or triangular central core leg and triangular side legs significantly reduces the overall dimensions of the transformer by constructing the side legs of the core so as to protrude into the space which would normally be immediately above or below the side legs of an E-E or E-I transformer.

U.S. Pat. No. 4,424,504 to Mitsui, et al. issued Jan. 3, 1984 entitled "Ferrite core" discloses a ferrite core for the use of a power transformer and/or a choke coil. The core is assembled by a pair of identical core halves, and each core half comprises (a) a circular center boss, (b) a pair of outer walls positioned at both the sides of said boss for mounting a coil, and (c) a pair of base plates coupling said center boss and said outer walls.

U.S. Pat. No. 4,597,169 to Chamberlin issued Jul. 1, 1986 entitled "Method of manufacturing a turnable microinductor" discloses a microcoil having a winding on a composite core made up of a portion of substantially magnetic material and a portion of substantially non-magnetic material. The winding is split so that a part of the magnetic material core portion is exposed, and a laser is used to remove material from the exposed part of the magnetic core portion. The inductance of the coil is measured during the removal of the magnetic material, and the inductance of the coil is trimmed to a desired value through the removal of an appropriate amount of magnetic material. The non-magnetic core portion serves as a support structure for the portions of the winding on the core even if a substantial portion of the magnetic material is removed.

U.S. Pat. No. 4,760,366 to Mitsui issued Jul. 26, 1988 entitled "Ferrite core" discloses a ferrite core for the use of a power transformer and/or a choke coil with small size. The core is assembled by a pair of identical core halves together with a bobbin wound a coil. Each of the core halves has an E-shaped structure with a center core on which a coil is wound, a pair of side legs and a base plate which couples the center core with the side legs. The cross section of the center core is not circular nor rectangular, but is flat having rectangular portion with a first side and a second side and a pair of arcs coupled with said first side.

U.S. Pat. No. 5,003,279 to Morinaga, et al. issued Mar. 26, 1991 entitled "Chip-type coil" discloses a chip-type coil whose terminal electrodes are formed directly on a magnetic core and each comprise a mixture of electrically conductive material with insulating material, so that specific resistance of the terminal electrode can increase so as to reduce an eddy current flowing in the terminal electrode, thereby limiting Q-deterioration in the chip-type coil.

U.S. Pat. No. 5,351,167 to Wai, et al. issued Sep. 27, 1994 entitled "Self-leaded surface mounted rod inductor" discloses an electronic component adapted for surface mounting on a PC board that has an elongate bobbin made of a dielectric material. A coil of wire is wound about the winding support surface of the bobbin. The coil has a pair of lead terminations which are wrapped around a pair of T-shaped lead termination support members extending from the same side of the bobbin. When the bobbin rests on top of a PC board, the support members position the wrapped lead terminations slightly above solder pads.

U.S. Pat. No. 6,005,467 to Abramov issued Dec. 21, 1999 entitled "Trimmable inductor" discloses a trimmable inductor comprising a supporting substrate having spaced apart lead terminals, a coil defined by an electrically conductive member mounted on the substrate in a continuous path of multiple turns forming a winding about an axis and extending between the lead terminals, and an electric conductive shorting member extending and electrically connected between one or more turns and a terminal of the coil to enable selective inclusion and elimination of at least part of one of the turns of the coil.

U.S. Pat. No. 6,087,920 to Abramov issued Jul. 11, 2000 entitled "Monolithic inductor" discloses a monolithic inductor comprising an elongated substrate having opposite distal ends and, each end having an end cap extending from the opposite ends to support the substrate in spaced relation from a PC board, the end caps being formed with non-mounting areas and a deflection area for preventing the substrate resting on the non-mounting area, a substantially steep side wall on the substrate side of the end cap at the non-mounting area, and an inclined ramp extending up to a top of the end cap on the substrate side substantially opposite the non-mounting area, an electrically conductive soldering band extending partially around each end cap, each soldering band having a gap at the non-mounting area for thereby reducing parasitic conduction in the band, and an electrically conductive layer formed on the substrate in a helical path extending between the opposite ends and in electrical contact with the conductive soldering bands at the ramps. See also U.S. Pat. No. 6,087,921 to Morrison issued Jul. 11, 2000 entitled "Placement insensitive monolithic inductor and method of manufacturing same".

U.S. Pat. No. 6,362,986 to Schultz, et al. issued Mar. 26, 2002 entitled "Voltage converter with coupled inductive windings, and associated methods" discloses a DC-to-DC converter that generates an output voltage from an input voltage. The converter includes first and second inductive windings and a magnetic core. One end of the first winding is switched at about 180 degrees out of phase with one end of the second winding, between ground and the input voltage. The first winding is wound about the core in a first orientation, and the second winding is also wound about the core in the first orientation so as to increase coupling between windings and to reduce ripple current in the windings and other parts of the circuit. Boost, buck-boost, or other versions are also provided. Each of the N windings is wound about the core in like orientation to increase coupling between windings and to reduce ripple current in the windings and other parts of the circuit. The invention also discloses magnetic core structures.

U.S. Pat. No. 6,483,409 to Shikama, et al. issued Nov. 19, 2002 entitled "Bead inductor" discloses a bead-type inductor which is constructed so as to be mass produced includes a substantially rectangular-parallelepiped core. The core includes an axial portion and an outer peripheral portion, and a coil is formed by winding a metal wire around the axial portion. The axial portion includes a central portion and a peripheral portion. A high strength material is used for the central portion. Metal caps are disposed on both ends of the core. The caps and the coil are connected electrically. In addition, the central portion of the axial portion may be a cavity.

United States Patent Publication No. 20040207503 to Flanders, et al. published Oct. 21, 2004 entitled "Self-damped inductor" discloses an inductor with self-damping properties for use in multiple applications including for high power broadband frequency applications. The inductor comprises a coil having an input end and an output end and wound about a core of magnetically permeable material and an eddy current generator incorporated either at the time of manufacture or post manufacturing. The core can be air (e.g., a hollow coil of wire). Alternative core materials are iron, iron powder, steel laminations and other appropriate materials. The core may be incorporated into some form of frame whether I shaped, U shaped, E shaped or of an encapsulated shape arrangement. The inductor's Q value may be changed selectively by deliberately inducing eddy currents in preferred locations. The eddy currents are induced into the inductors and have the effect of introducing a back EMF which is designed and scaled appropriately to adjust the Q value at the desired frequency resulting is less phase distortion.

Despite the foregoing broad variety of prior art inductor configurations, there is a distinct lack of a simplified and low-cost inductor configuration that provides a high degree of uniformity (tolerance). This high tolerance is often desirable for electronic circuit elements, especially were two or more such components are disposed in a common circuit. For example, in power supply applications, the recent trend has been to distribute current or load associated with components in the power supply across multiple similar components, such as replacing one 100A inductor with four (4) 25A inductors. This technique of distribution, however, also requires a high degree of uniformity or tolerance between the e.g., four devices; otherwise, additional components (such as a sense resistor) may be required, thereby adding additional cost and labor.

Typical prior art inductive device used in such applications are discrete components which may or may not have high tolerance. For example, different cores having slightly different material compositions, dimensions, thermal properties, shrinkage, etc. may be used, thereby causing each of the four devices in the aforementioned example to have slightly different inductance values.

Also, some prior art inductive devices use "loop back" style (multi-turn) windings which introduce additional winding run length into the device, and also do not make the most efficient use of the core in terms of, inter alia, magnetic flux density distribution.

SUMMARY OF THE INVENTION

The present invention satisfies the foregoing needs by providing an improved inductive apparatus and methods of manufacturing, utilizing and installing the same.

In a first aspect of the invention, an improved high-tolerance inductive device is disclosed. In one embodiment, the device comprises a unitary core base having a plurality of legs onto which one or more windings are disposed. A cap provides magnetic coupling for the windings of each leg. Use of a common core with a unitary base element provides significantly enhanced inductance tolerance and electrical performance (including reduced EMI radiation). Use of "one pass" windings on the device also mitigates radiated EMI and allows the core to be more magnetically efficient.

In a second aspect of the invention, a multi-leg magnetically permeable core is disclosed. In one embodiment, the core comprises a base element and cap element, and is made from ferrite. The core base comprises four (4) substantially identical legs disposed in a symmetrical fashion. A center post and outer risers on each leg provide magnetic coupling with the cap element for the inductor windings disposed on each leg. The relationship between cap and center post/outer risers can be varied as desired to provide the desired electrical and magnetic properties.

In a third aspect of the invention, a method of manufacturing the aforementioned inductive device is provided. In one embodiment, the method comprises: providing a magnetically permeable core base element and corresponding cap element having the desired features; providing one or more windings; disposing the windings onto the core on each leg thereof; and mating the core cap element to the base element.

In a fourth aspect of the invention, a method of mounting the inductive device on a parent device is disclosed. In one embodiment, the method comprises: providing a parent device (e.g., PCB) having one or more features which facilitate electrical mating with the inductive device; disposing the assembled device onto the parent device such that the self-leaded portions of the inductive device are at least proximate to the corresponding features of the parent device; and bonding the pads of the inductive device to the corresponding features of the parent device.

BRIEF DESCRIPTION OF THE DRAWINGS

The features, objectives, and advantages of the invention will become more apparent from the detailed description set forth below when taken in conjunction with the drawings, wherein.

DETAILED DESCRIPTION OF THE INVENTION

Reference is now made to the drawings wherein like numerals refer to like parts throughout.

As used herein, the term "magnetically permeable" refers to any number of materials commonly used for forming inductive cores or similar components, including without limitation various formulations made from ferrite.

As used herein, the term "winding" refers to any type of conductor, irrespective of shape, cross-section, or number of turns, which is adapted to carry electrical current.

Overview

The present invention provides, inter alia, improved inductive apparatus and methods for manufacturing, and installing the same.

As noted above, a high degree of uniformity (tolerance) is often desirable for electronic circuit elements, especially were two or more such components are disposed in a common circuit. The present invention is advantageously adapted to overcome the disabilities of the prior art by (i) providing a common core configuration which eliminates many of the potential differences between the inductance values of individual or discrete inductive devices; (ii) utilizing core configurations which are efficient in terms of both flux density distribution and space/footprint consumption; and (iii) utilizing core configurations which having reduced manufacturing cost.

In one exemplary embodiment, the inductive device is also configured to be self-leaded, thereby further increasing its spatial density, simplicity, and ease of use, and reducing its cost of manufacturing.

Exemplary Embodiments

Referring now to FIGS. 1*a*-*e*, a first exemplary embodiment of the present invention is described in detail. It will be recognized that while the following discussion is cast in terms of an inductor, the invention is equally applicable to other inductive devices (e.g., transformers).

Figure 1:
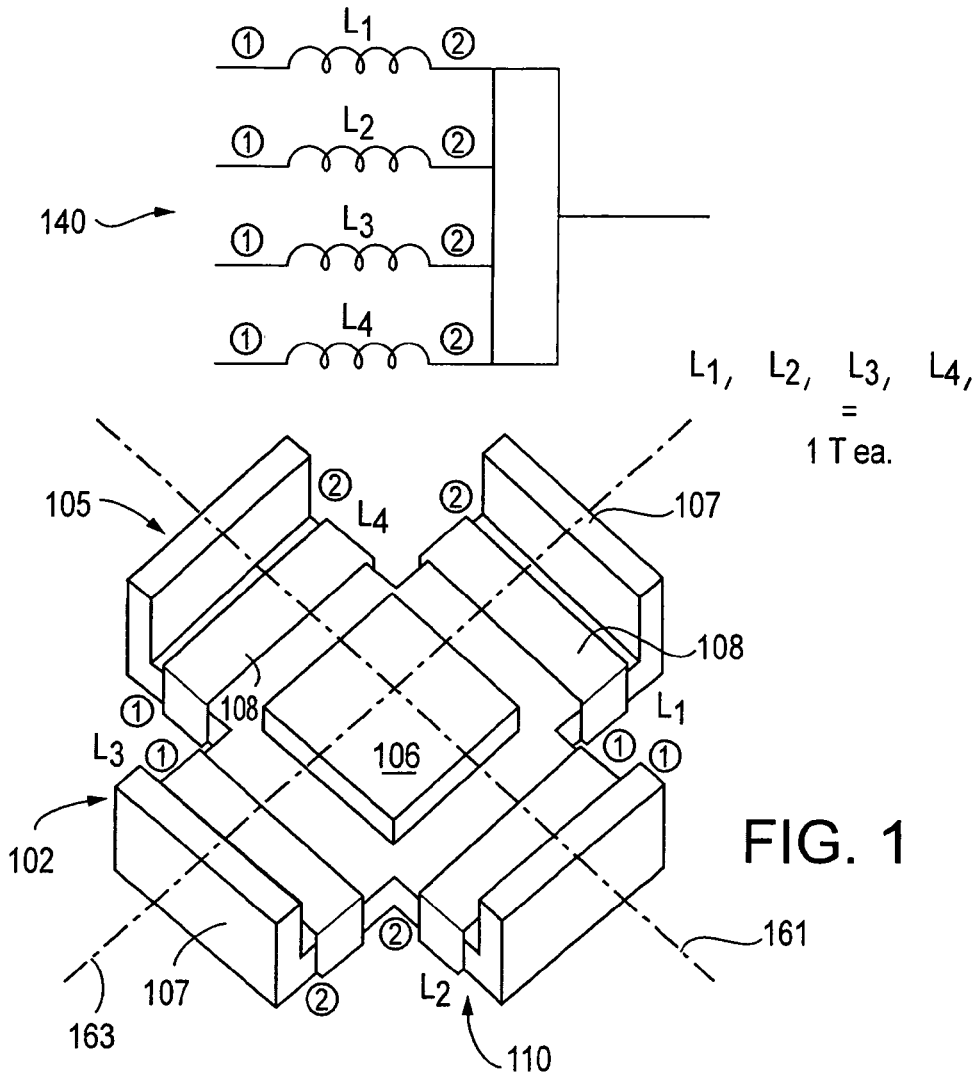
FIG. 1 is a top perspective view of one exemplary embodiment of the improved inductive device of the present invention.
Figure 1A:
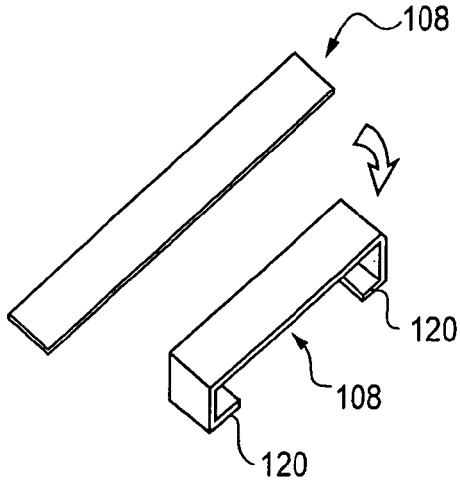
FIG. 1*a* is a top perspective view of one exemplary embodiment of a winding used in the inductive device of FIG. 1.

FIGS. 1*a*-*e* show an illustrative embodiment of an inductive device 100 comprising a "common" or unitary core inductor (without cap element 114, described below). FIG. 1 shows a perspective view of the device 100 which generally comprises a device core 102 having a plurality of legs 104 and a central core element 106. The core 102 generally comprises a substantially planar bottom face, while the top face 105 is irregular and includes the core element 106 and the vertical risers 107. The height, cross-sectional area, and profile of the central core element 106 and risers 107 can be adjusted as desired (discussed in greater detail below) in order to provide the desired electrical properties.

The core 102 is, in the illustrated embodiment, either formed directly as shown or alternatively machined from a block to have the desired number of legs 104, e.g., either two (see FIG. 3) or four (FIG. 1). Hence, using the latter approach, a common block can be used as the basis for multiple different designs, and no special (expensive) additional tooling is required. For example, where a device is destined to have two legs, the additional legs 104 can simply be machined off. Notwithstanding the foregoing, it will be appreciated that the core of the present invention can feasibly be made to have any number of legs including even odd numbers (see, e.g., the device 180 of FIG. 1*f*), and may be hybridized in any number of facets including combined use of stepped and non-stepped risers 187, use of varying thickness windings 188, non-symmetric geometries, etc.

It will further be appreciated that a salient benefit of the use of a common core as in FIG. 1 is the ability to achieve very high (tight) tolerances between the individual inductors (L1-L4), stemming largely from the common or identical properties of the cores used for each device. As shown in the exemplary schematic 140 of FIG. 1, such tight tolerances obviates use of a sense resistor or other device in the circuit, thereby allowing for increased simplicity and reduced cost as compared to prior art solutions with lower tolerance.

Additionally, the size and geometry of the center core element 106 can be varied depending on the operation of the inductors L1-L4. For example, where all magnetic currents within the core are additive in the center element 106, a larger cross-section element may be used. Alternatively, where the currents are destructive or "buck", a smaller element may be used. Also, the center element 106 can have a different cross-sectional shape (and even taper), such as for example circular, elliptical, hexagonal, triangular, etc.

It will also be recognized that the illustrated core configuration of FIG. 1 provides for a more centralized noise profile as compared to, e.g., four discrete inductors in-line. This benefit relates largely to the common core 102, with the central element 106 in effect magnetically "tying" the four inductors L1-L4 together within a contained (capped) volume. This makes use of the present device 100 also more desirable in applications where radiated EMI is critical, such as in high-density, low-noise surface mount applications. The device 100 may also be externally shielded if desired using any one of myriad well-known shielding technologies available in the art (such as tin plating or use of a wrap-around Faraday shield).

A plurality of windings 108 are disposed (one each) on each of the legs 104 in a wrap-around fashion (FIG. 1*a*), such that at least a portion (pads 120) of the windings 108 are disposed proximate to the underside 110 of the device core 102. This approach advantageously allows for self-leading, described below, wherein the pads 120 of the windings 108 comprise, inter alia, mounting points for electrically connecting the device 100 to the parent PCB. As such, the pads 120 may be electrically connected to the parent PCB in any number of ways well known in the art (e.g. solder joints, direct forced physical contact, bonding, etc.). Furthermore, different types of pad and winding structures may be used with the device as is well known in the electronic arts, including without limitation terminal pins, balls, and surface mount (i.e., "L" shaped) leads. The windings 108 (and hence the pads 120, which are merely part of the windings 108) are made of electrically conductive materials (e.g., copper or copper alloys), although other materials may be used.

It will further be recognized that the windings 108 and conductive pads may be actually formed onto the core 102 itself, such as for example where the windings are coated or plated onto the surface of the core 102 (not shown), such as within recesses formed within the legs 104 of the 102. The conductive windings 108 can also feasibly be sprayed on as well, i.e., as a thin layer of conductive material on the surface of the core 102. Myriad other approaches to providing conductive traces on one or more surfaces of the core 102 may be used consistent with the invention, all such variants being readily implemented by those of ordinary skill provided the present disclosure.

Furthermore, it will be appreciated that the various windings may be made heterogeneous in, e.g., inductance, thickness, height, interface configuration (i.e., pin, SMT, etc.), and/or material. Myriad different variations of these different parameters are possible in order to produce a device with the desired qualities.

The core 102 of the embodiment of FIG. 1 also advantageously has the property of two-dimensional symmetry or non-chirality, which aids in manufacturing. Specifically, the core 102 as shown in FIG. 1 has symmetry along its two planar axes 161, 163 (i.e., those disposed along the legs 104 the core 102). Hence, an individual or machine manufacturing the device 100 of FIG. 1 can pick up a prepared core 102 from a bin or pile of such devices, and attach each winding 108 (assuming common configuration) to any leg 104 thereof without having to orient the core 102 as to any particular dimension(s). This greatly simplifies and expedites the assembly process.

Figure 1B:
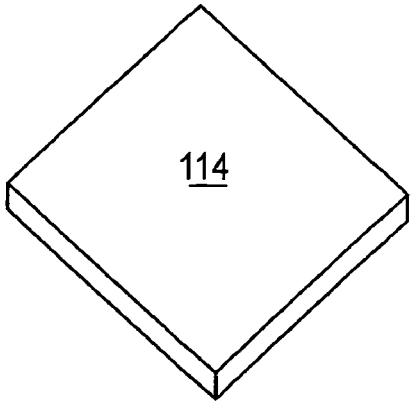
FIG. 1*b* is a top perspective view of the core cap element of the device of FIG. 1.

FIG. 1*b* illustrates an exemplary cap element 114 used with the device 100 of FIG. 1. This cap element 114 is ideally formed from identical material to that of the core 102, which the cap element 114 sits atop when assembled. The cap 114 is substantially planar in the illustrated embodiment, although it can be made in literally any shape (including relief on its underside akin to that shown in FIGS. 8*a* and 8*b*). Furthermore, the cap 114 and core 102 can be made such that any desired relationship exists between the relevant portions of the underside of the cap and the (i) central element 106, and (ii) the top surfaces of the risers 107. For example, in one embodiment, the central element 106 supports the cap 114, with an air gap of desired shape and magnitude being formed between the cap 114 and the individual risers 107. As is well known in the magnetics art, the size and geometry (and interposed material if any) of the gap controls, inter alia, the magnetic flux density passing through the gap and the leakage inductance of the device 100.

The top edges of the risers 107 may also be shaped, stepped or tiered (see exemplary risers of FIGS. 6*a* and 6*b*) to create complex gap configurations which can be used to adjust the magnetic and electrical properties of each inductor (or the device as a whole) including, e.g., energy storage in each leg 104 and flux density across each leg/cap interface. This also can affect the geometry and requirements of the central element 106, whose cross-sectional area for example is dictated at least in part by the geometry of the leg/cap interfaces.

Materials of desired magnetic properties (e.g., permeability) may also be placed within all or a portion of the gap(s), such as where a Kapton (polyamide) layer or the like is interposed between the core members. This layer may also provide an adhesive or structural function; i.e., retaining the various components in a fixed relative position.

As described above, the windings 108 (and the device 100 as a whole) are self-leaded. In this context, the term "self-leaded" refers to the fact that separate terminals electrically connecting the windings 108 to corresponding pads on the PCB or parent device, are not needed. One advantage of having self-leaded windings is to minimize the component count and complexity of the device 100, as well as increasing its reliability.

When the assembled device 100 is disposed on the parent device (e.g., PCB), the contact pads 120 of the windings are situated proximate to the PCB contacts pads, thereby facilitating direct bonding thereto (such as via a solder process). This feature obviates not only structures within the device 100, but also additional steps during placement on the PCB.

In yet another alternative, the free ends of the windings 108 are received within apertures (not shown) formed in the PCB or other parent device when the inductor device 100 is mated thereto. The free ends are disposed at 90 degrees (right angle) to the plane of the core, such that the point downward to permit insertion into slots formed in the PCB. Alternatively, the windings 108 can be deformed around the legs 104 in somewhat of a dog-leg shape (when viewed from the side of the winding), thereby allowing for the aforementioned insertion, as well as providing a very firm coupling between the core leg 104 and the relevant winding 108 since the winding wraps under each leg somewhat before projecting normally toward the surface of the PCB.

Figure 2:
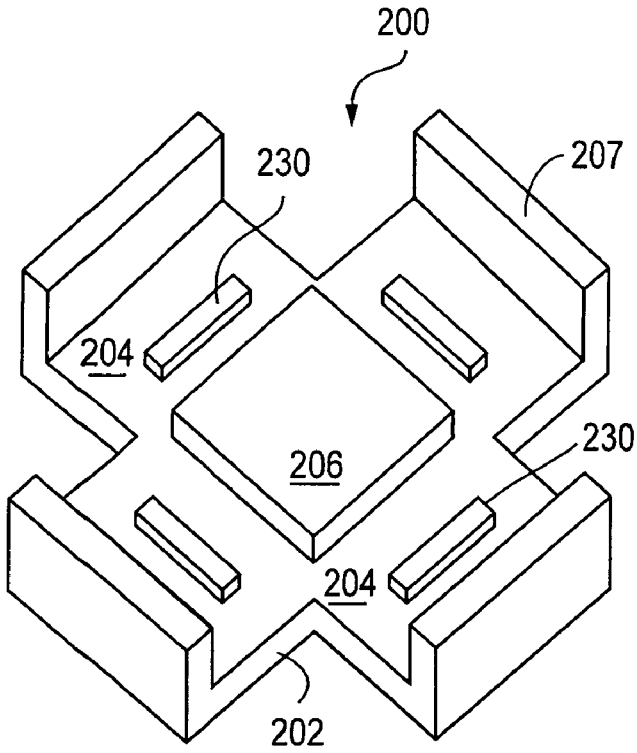
FIG. 2 is a top perspective view of another exemplary embodiment of the improved inductive device of the present invention, adapted for multiple windings on each leg.
Figure 2A:
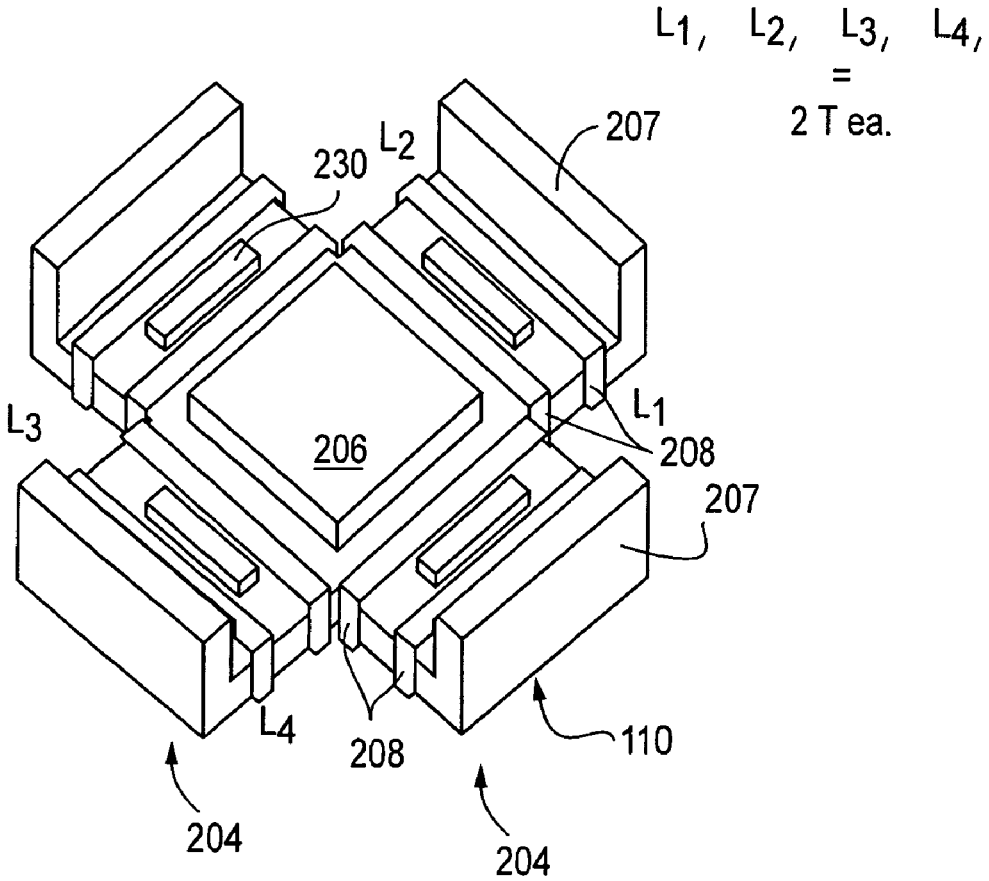
FIG. 2*a* is a top perspective view of the inductive device of FIG. 2, with windings installed.

FIG. 2 is a top perspective view of another exemplary embodiment of the improved inductive device 200 of the present invention, adapted for multiple windings on each leg. A retention element 230 is formed on each leg 204 to permit positive separation and alignment of the two windings 208 of each leg, as shown in FIG. 2*a*.

Figure 1C:
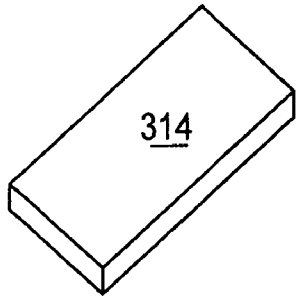
FIG. 1*c* is a top perspective view of an alternate embodiment of the core cap element.
Figure 1D:
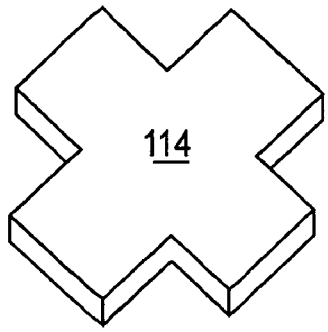
FIG. 1*d* is a top perspective view of another alternate embodiment of the core cap element.
Figure 1E:
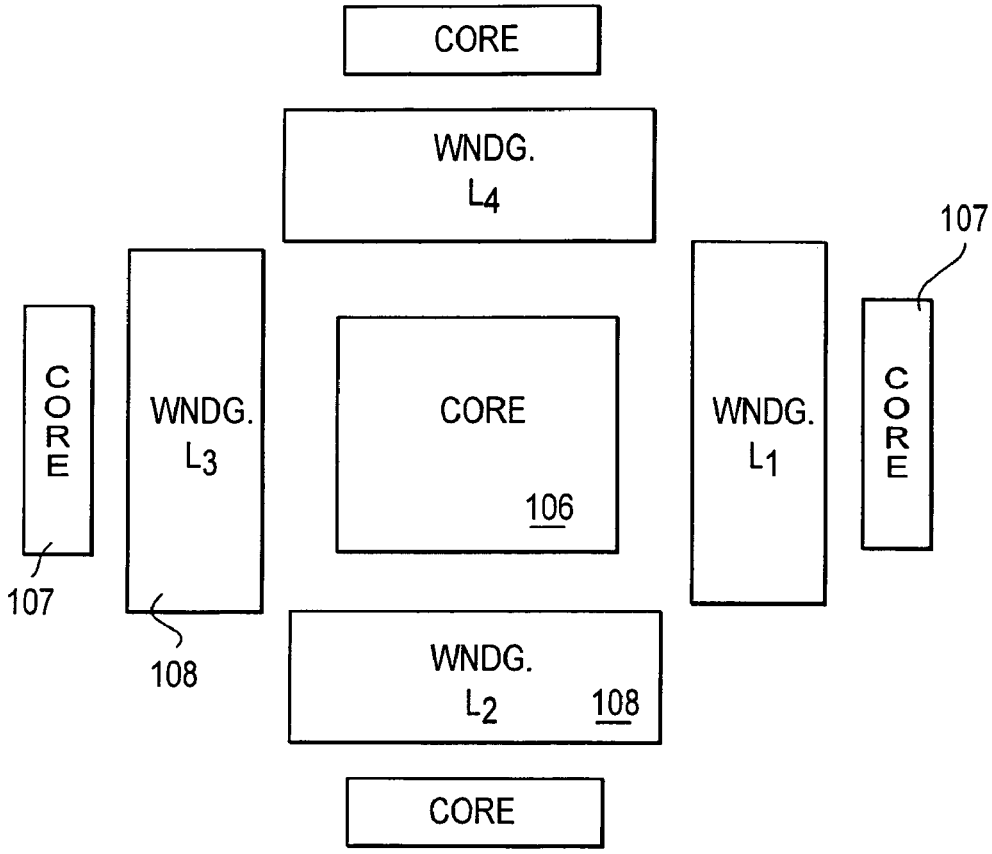
FIG. 1*e* is a top plan view of the device of FIG. 1.
Figure 1F:
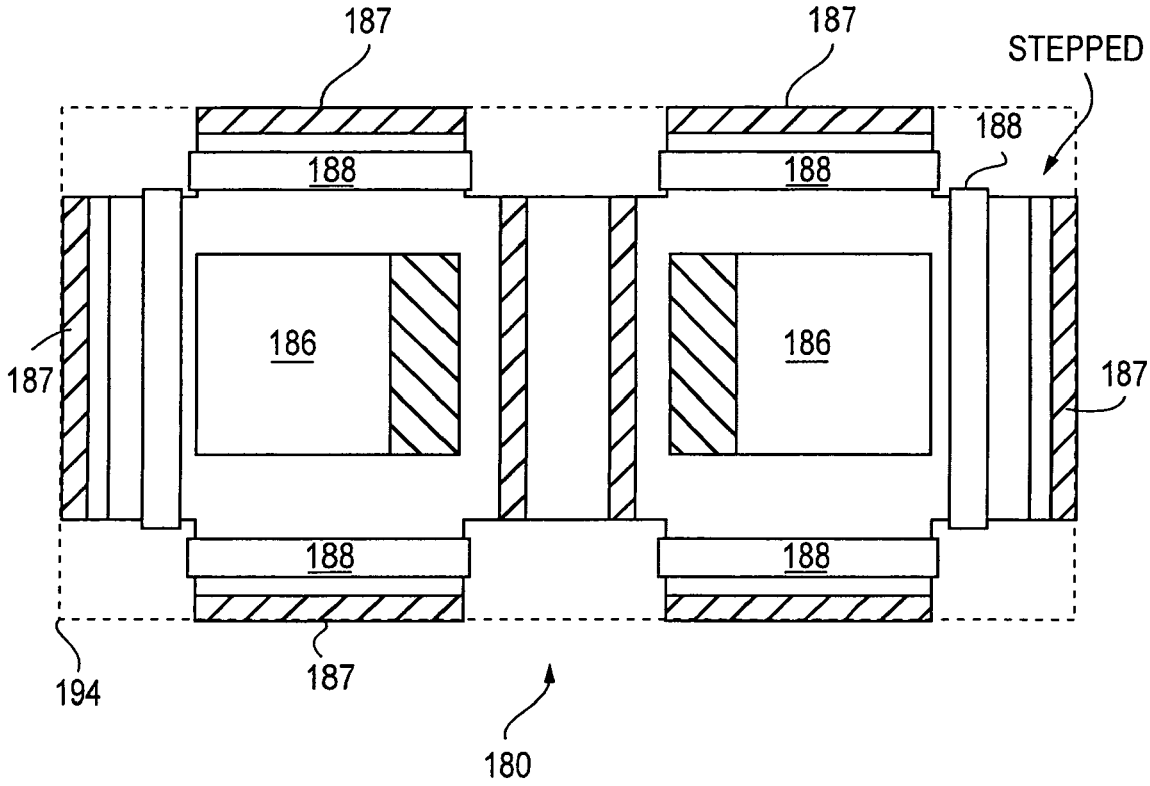
FIG. 1*f* is a top plan view of another alternate embodiment of the inductive device, having a plurality of legs and heterogeneous riser and winding configurations.
Figure 3:
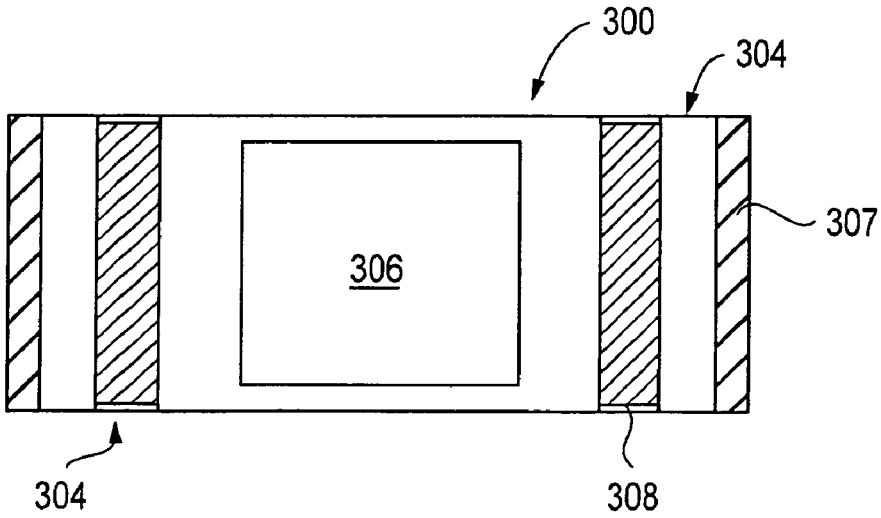
FIG. 3 is a top elevational view of another exemplary embodiment of the improved inductive device of the present invention, having only two legs.

FIG. 3 is a top elevational view of another exemplary embodiment of the improved inductive device 300 of the present invention, having only two legs 304. This is useful where only two inductors are required, or alternatively where only two inductors with identical properties are required. This configuration is also very space efficient, since multiple such devices 300 can be disposed in juxtaposed or end-to-end alignment with minimal wasted board space there between. The core cap element 314 of FIG. 1*c* is used with this device 300, although others may be used.

Figure 4:
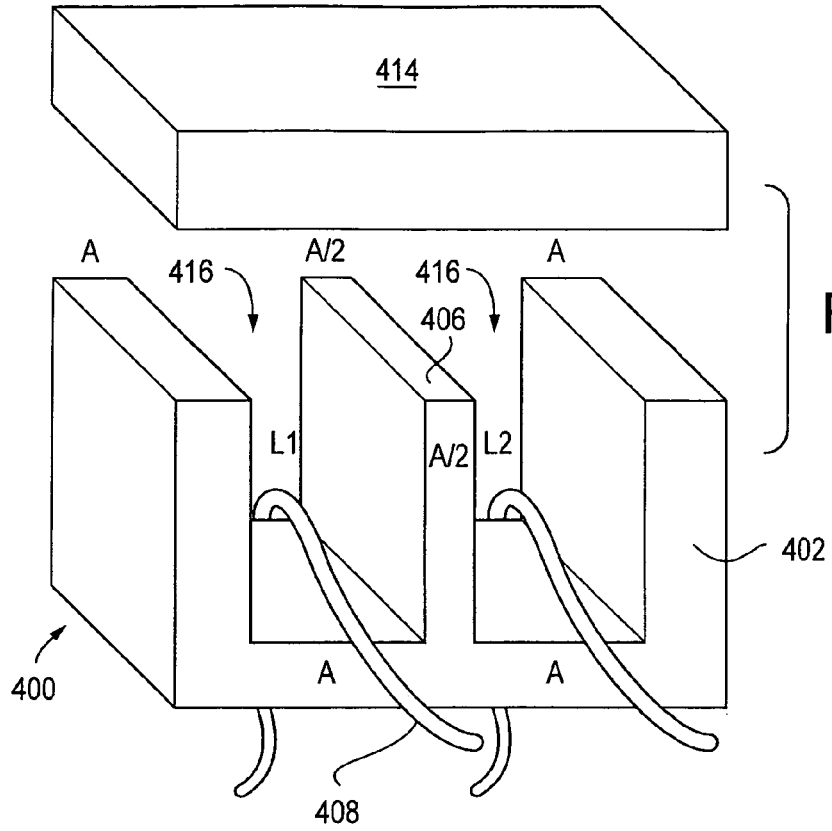
FIG. 4 is a front perspective view of another exemplary embodiment of the inductive device of the invention, having multiple (e.g., two) juxtaposed windings disposed within a common core with center leg.

FIG. 4 is a front perspective view of another exemplary embodiment of the inductive device 400 of the invention, having multiple (e.g., two) juxtaposed windings 408 disposed within a common core 402 with center riser 406. Advantageously, each winding 408 has only one substantially linear "turn" through its respective core aperture 416, thereby allowing for optimal flux density and reduced winding run (as associated EMI). This configuration permits the center riser 406 to be thinner in width (smaller area), since the magnetic currents tend to cancel one another within the riser 406. The two inductors effectively act independent of one another in this device.

Figure 5:
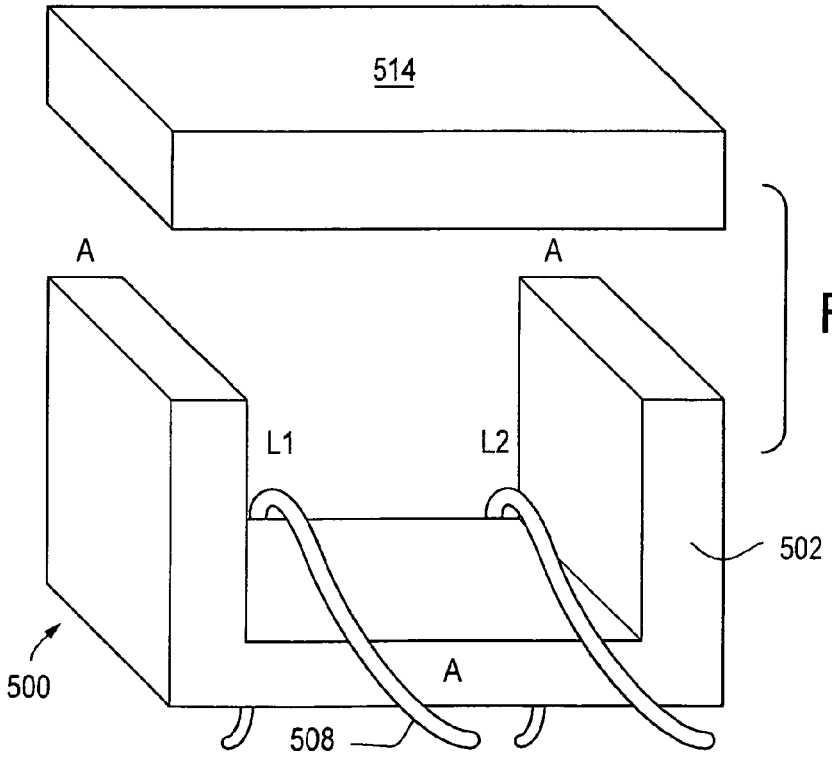
FIG. 5 is a front perspective view of another exemplary embodiment of the inductive device of the invention, having multiple (e.g., two) juxtaposed windings disposed within a common core with no center riser.

FIG. 5 is a front perspective view of another exemplary embodiment of the inductive device 500 of the invention, having multiple (e.g., two) juxtaposed windings disposed within a common core with no center riser. The two inductors effectively act as coupled inductors in this device due primarily to the absence of the center riser.

Figure 6:
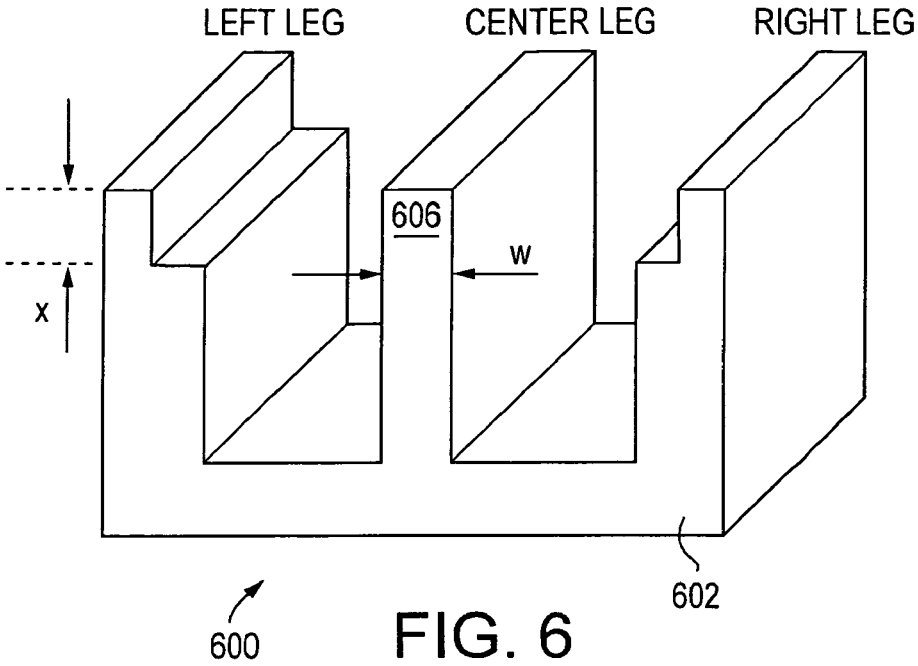
FIG. 6 is a front perspective view of the base core element another exemplary embodiment of the inductive device of the invention, having multiple (e.g., two) juxtaposed windings disposed within a common core with center risers and stepped or tiered outer risers.
Figure 7:
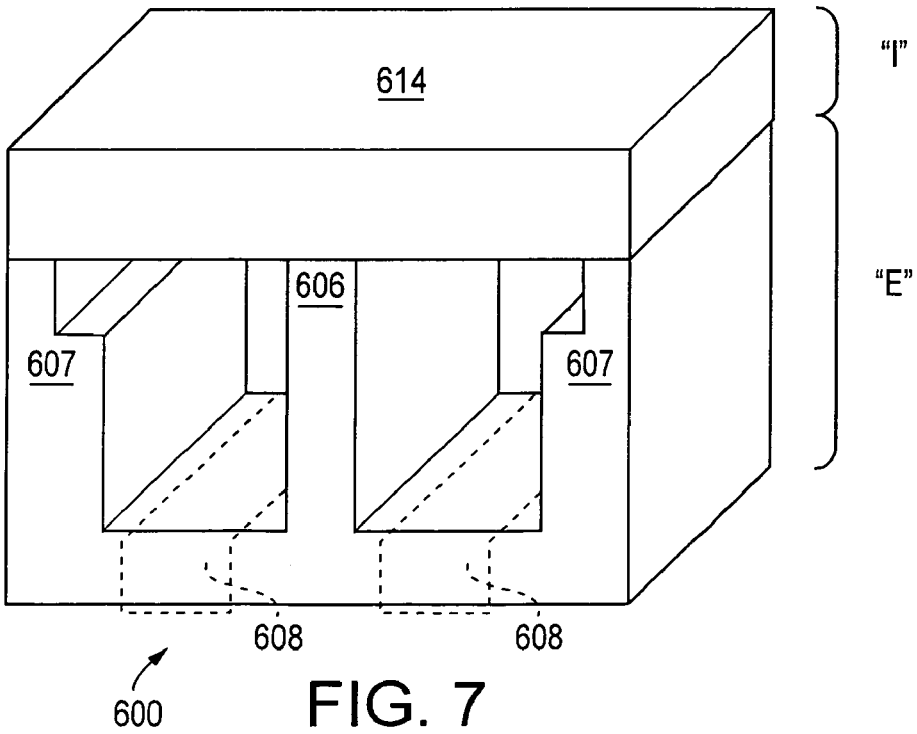
FIG. 7 is a front perspective view of the device of FIG. 6, having cap element installed.

FIG. 6 is a front perspective view of the base core element another exemplary embodiment of the inductive device 600 of the invention, having multiple (e.g., two) juxtaposed windings 608 disposed within a common core with center riser 606 and stepped or tiered outer risers 607. The height of the step (x) and the width of the center riser 606 (w) are also controllable to provide the desired gap configuration and magnetic/electrical properties. FIG. 7 is a front perspective view of the device 600 of FIG. 6, having cap element 614 installed.

Figure 8A:
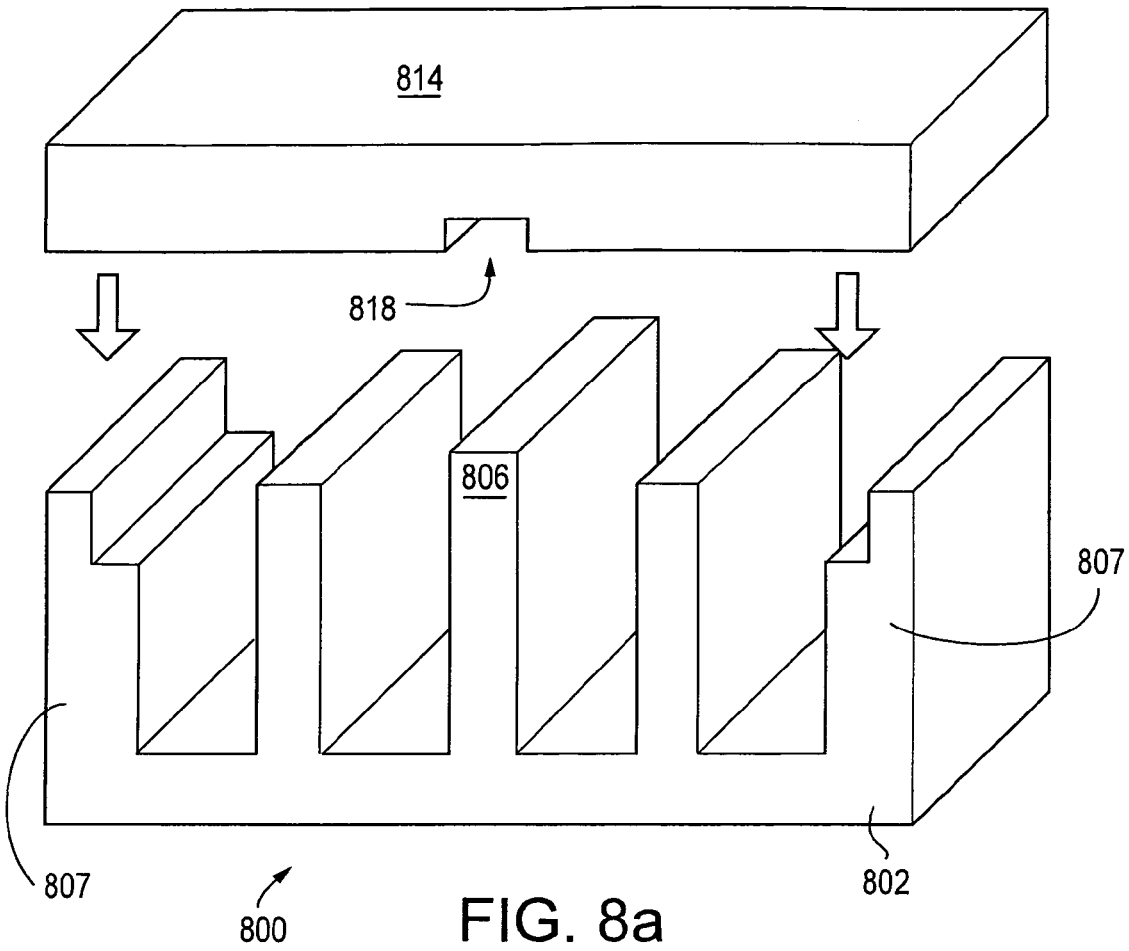
FIGS. 8*a* and 8*b* illustrate yet another embodiment of the improved inductive device, having four juxtaposed windings and controlled stepped gaps on the outer core risers.
Figure 8B:
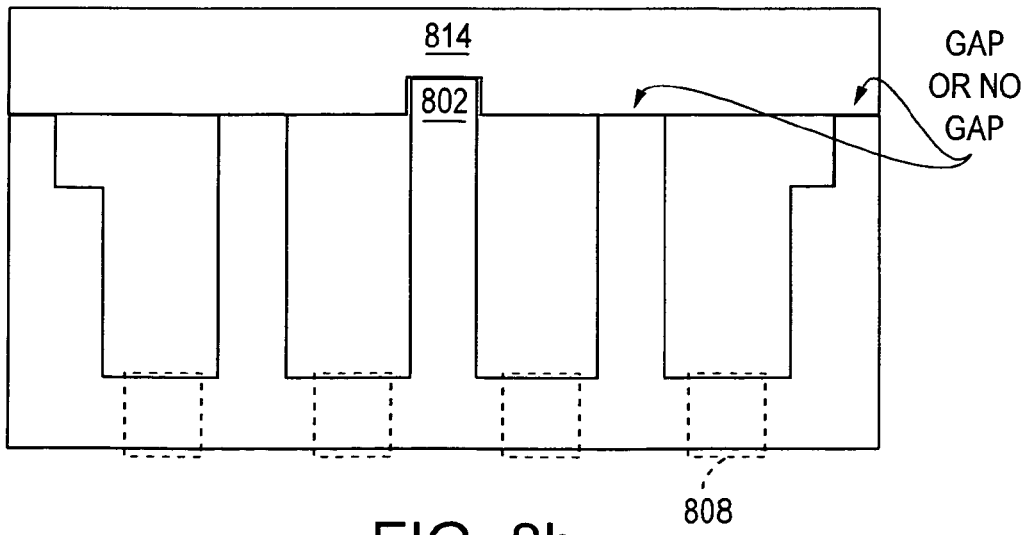

FIGS. 8*a* and 8*b* illustrate yet another embodiment of the improved inductive device 800, having four (4) juxtaposed windings 808 and controlled stepped gaps on the outer core risers 807. The cap 814 is also relieved to provide a recess 818 for the center riser 806, thereby allowing for outer riser 807 gap control if desired (not shown).

Figure 9A:
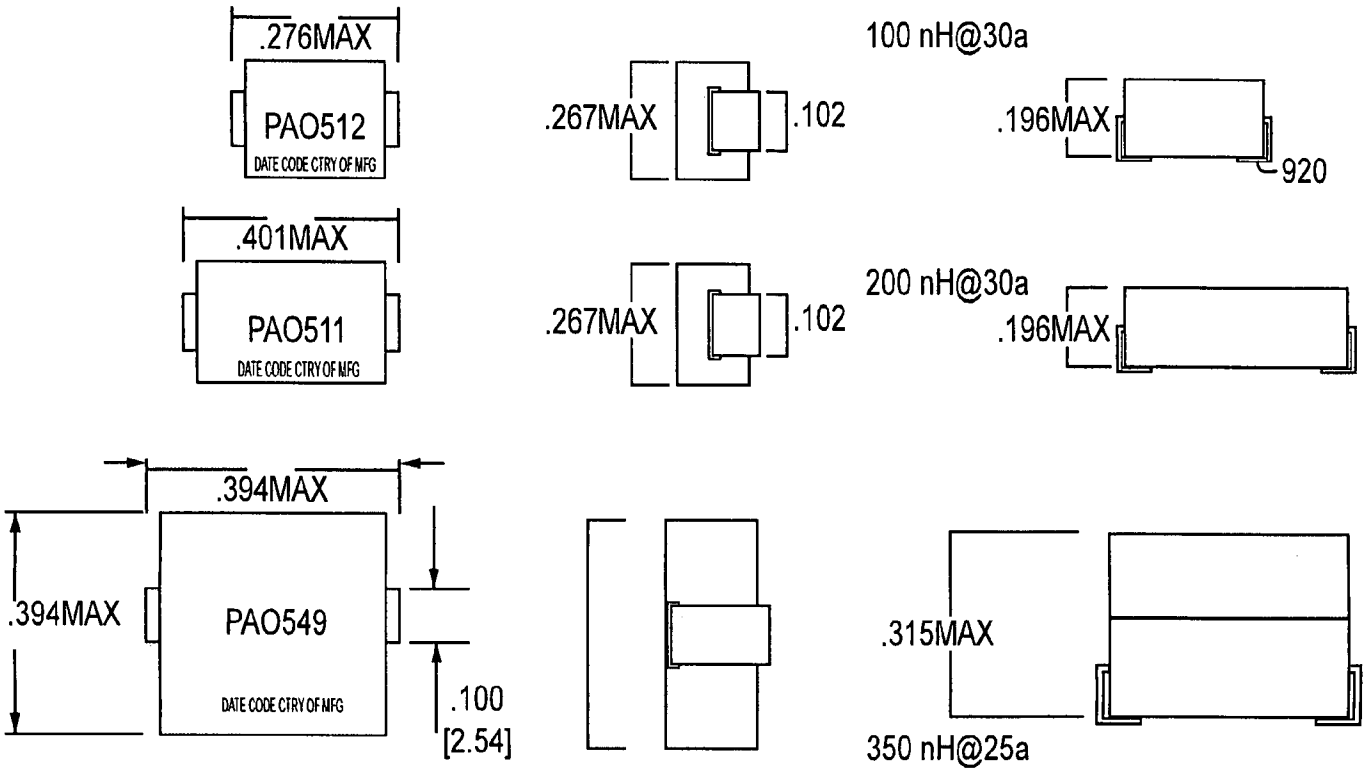
FIG. 9a (PRIOR ART)
FIG. 9*a* illustrates several different prior art inductive device configurations adapted for surface mount.

FIG. 9*a* illustrates several different prior art inductive device configurations adapted for surface mount.

Figure 9B:
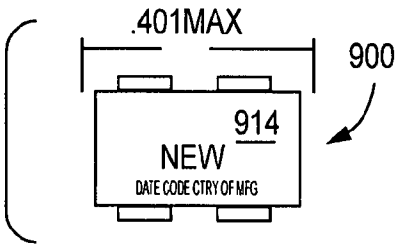
FIG. 9*b* illustrates one embodiment of an improved inductive device having two tandem or juxtaposed windings and being adapted for surface mount.

FIG. 9*b* illustrates one embodiment of an improved inductive device having two tandem or juxtaposed windings and being adapted for surface mount.

Figure 10A:
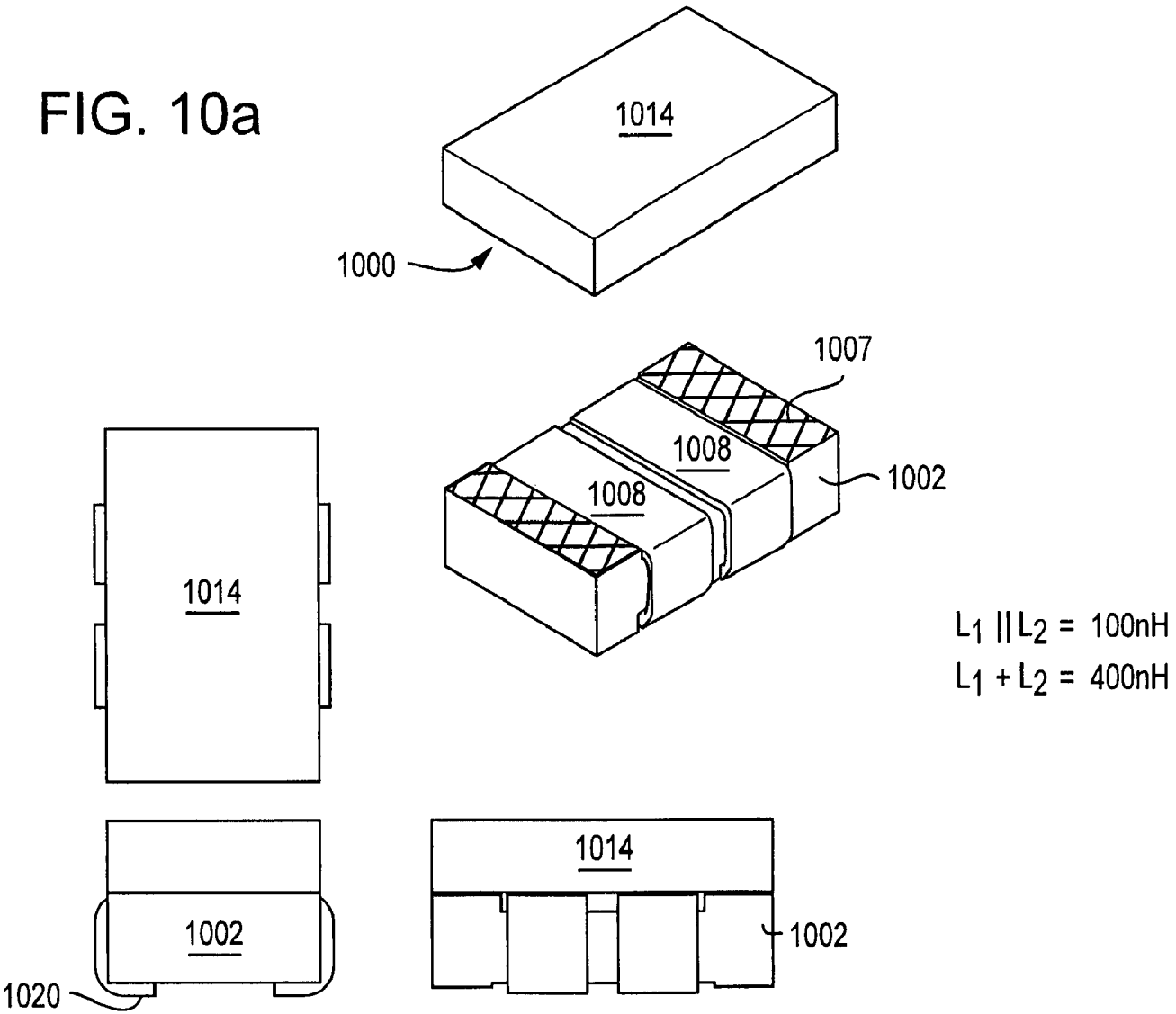
FIGS. 10*a*-10*c* illustrate various different variants of the tandem winding device of FIG. 9*b*, configured for providing (i) two coupled inductors, (ii) two independent inductors, and (iii) a common mode choke, respectively.
Figure 10B:
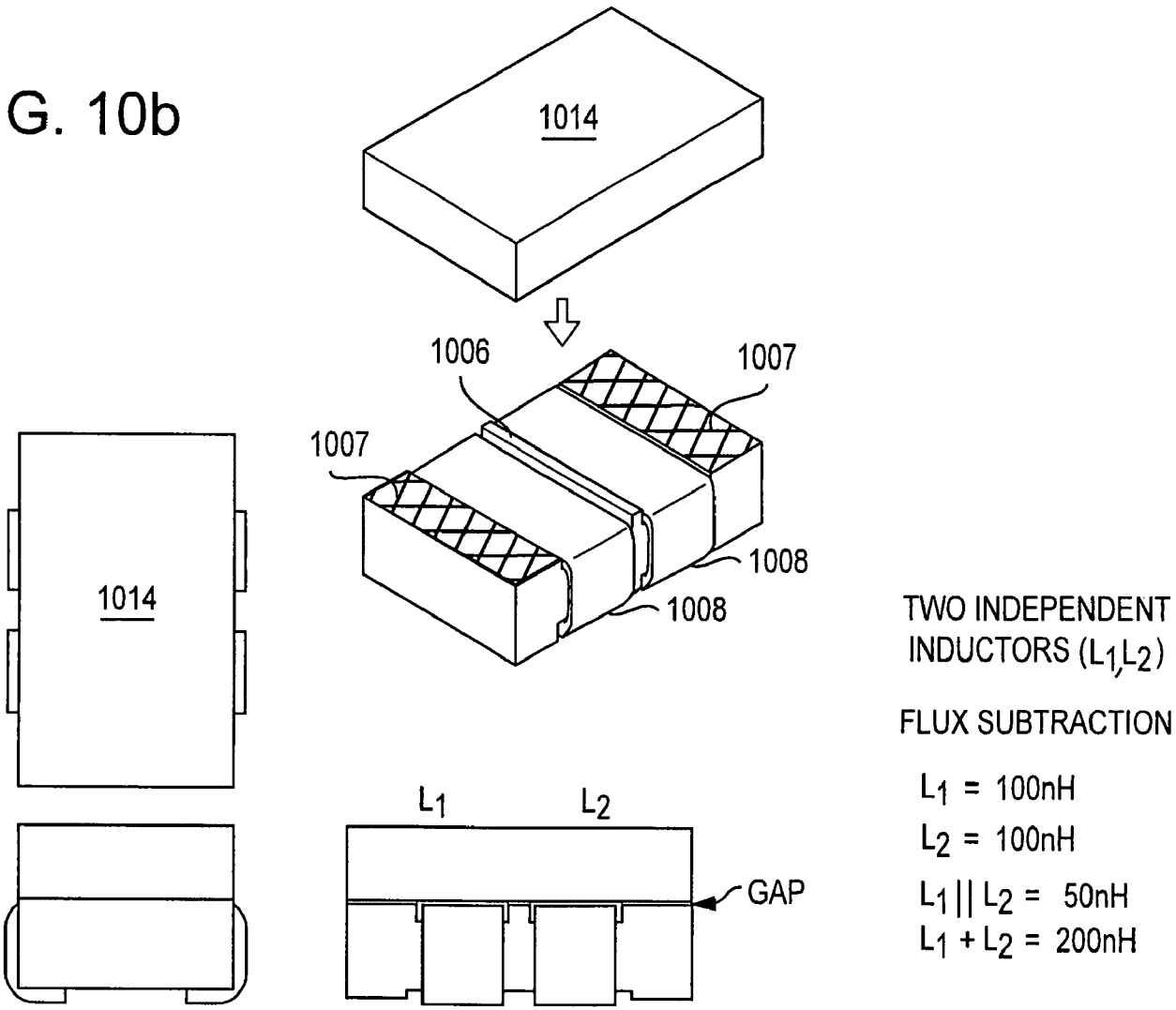
Figure 10C:
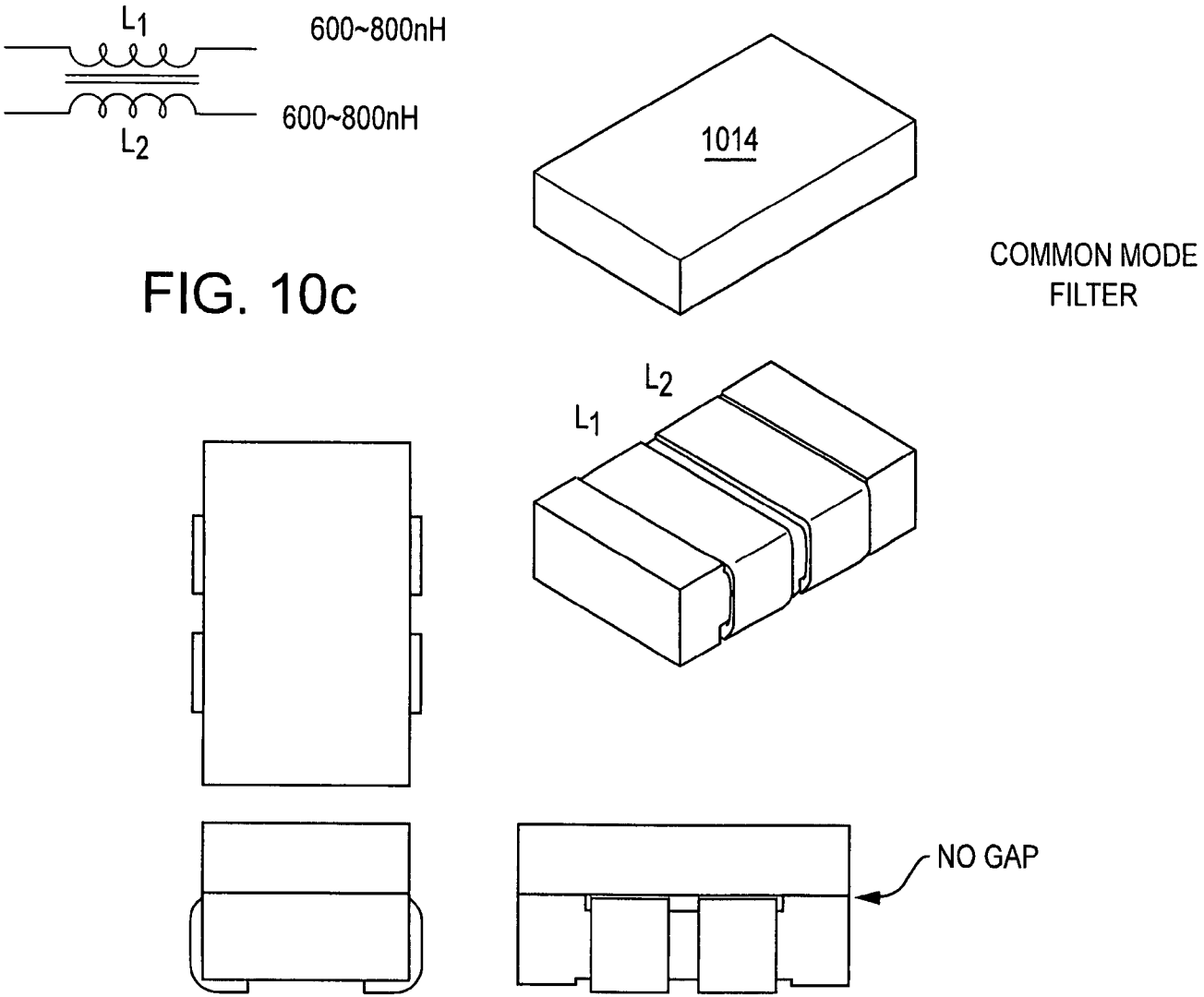

FIGS. 10*a*-10*c* illustrate various different variants of the tandem winding device of FIG. 9*b*, configured for providing (i) two coupled inductors, (ii) two independent inductors, and (iii) a common mode choke, respectively.

Figure 11A:
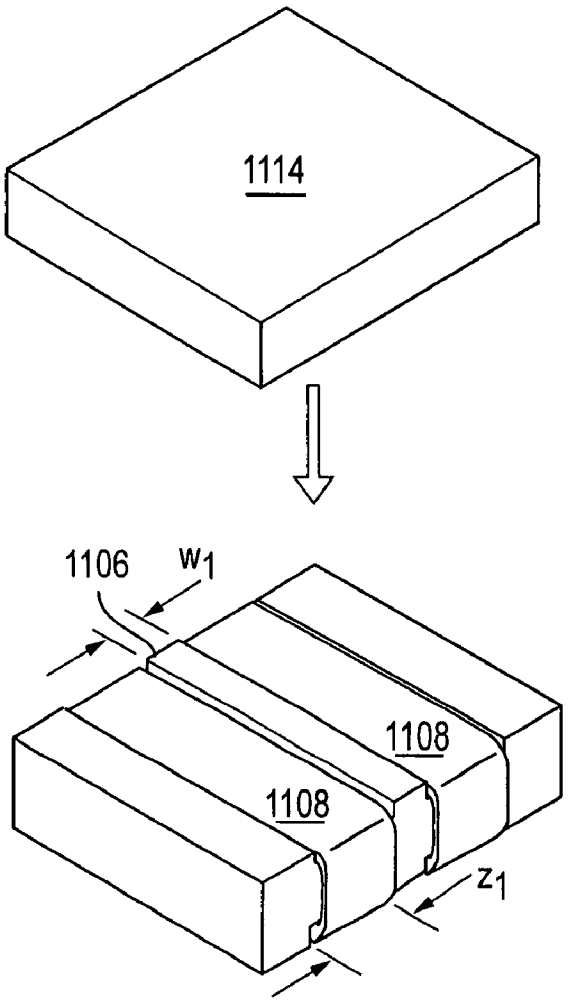
FIGS. 11*a* and 11*b* illustrate yet another exemplary embodiment of the inductive device of the invention, having a narrower center riser and wider windings.
Figure 11B:
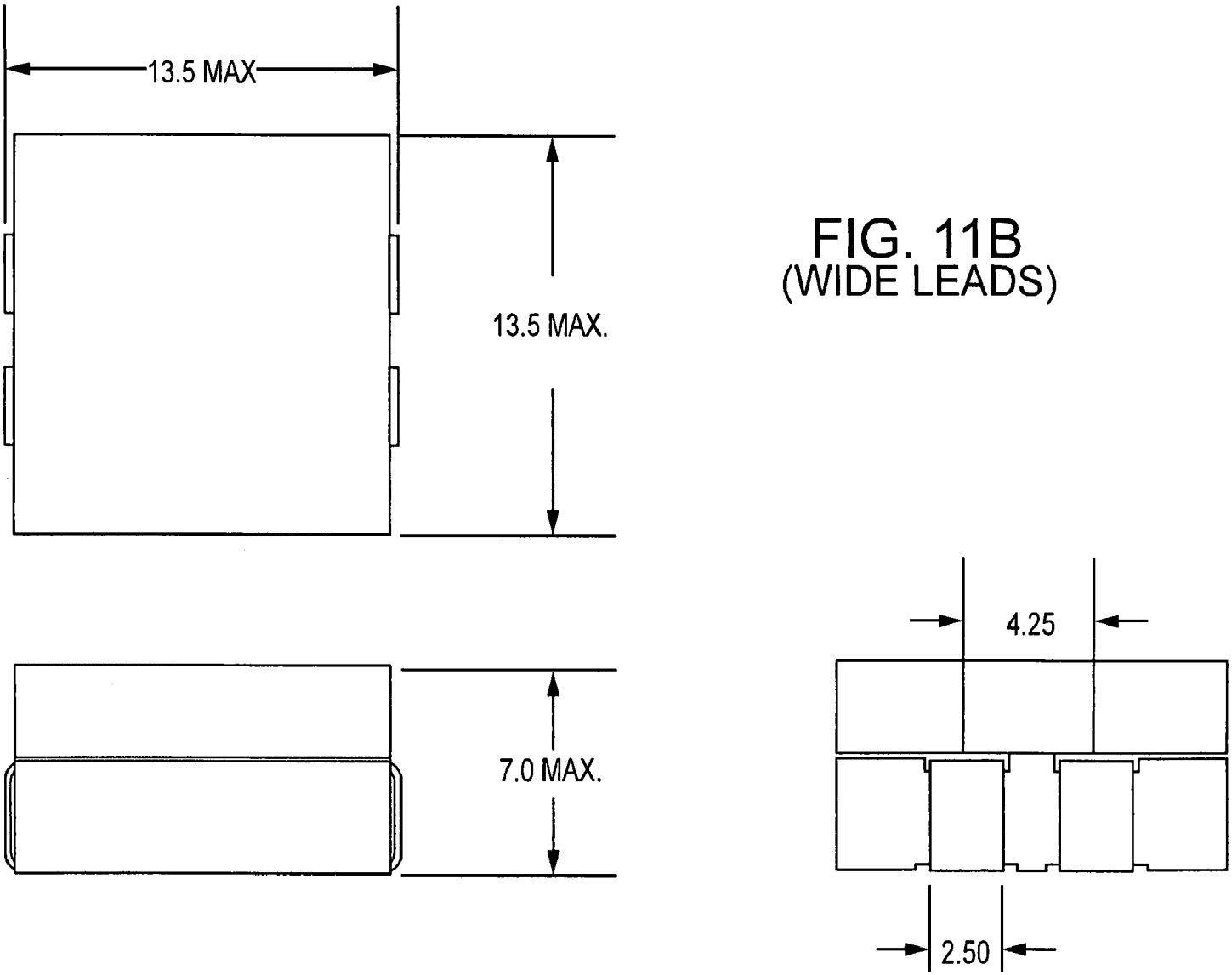

FIGS. 11*a* and 11*b* illustrate yet another exemplary embodiment of the inductive device 1100 of the invention, having a narrower center riser 1106 and wider windings 1108.

Figure 12A:
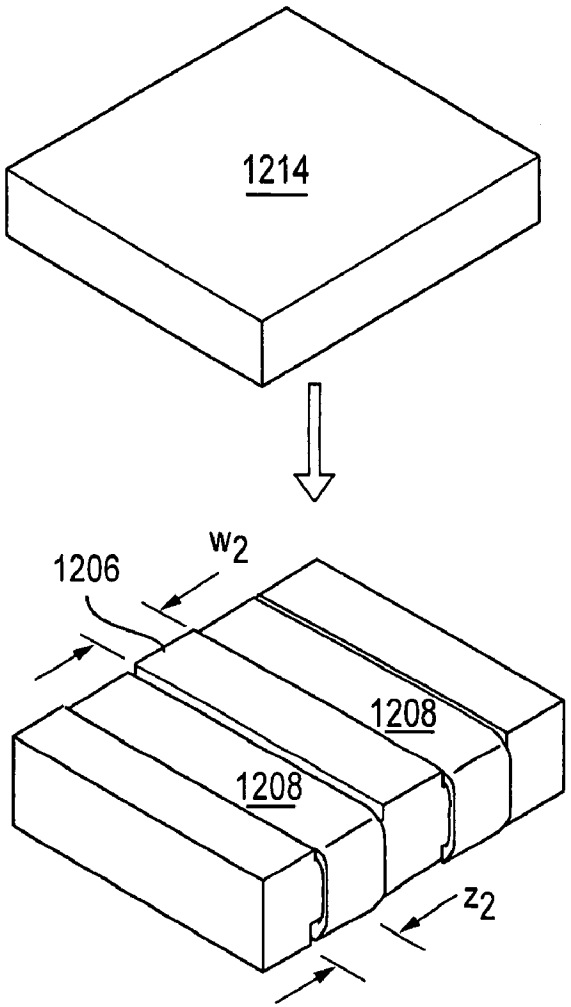
FIGS. 12*a* and 12*b* illustrate still another embodiment of the inductive device of the invention, having a wider center riser and narrower windings.
Figure 12B:
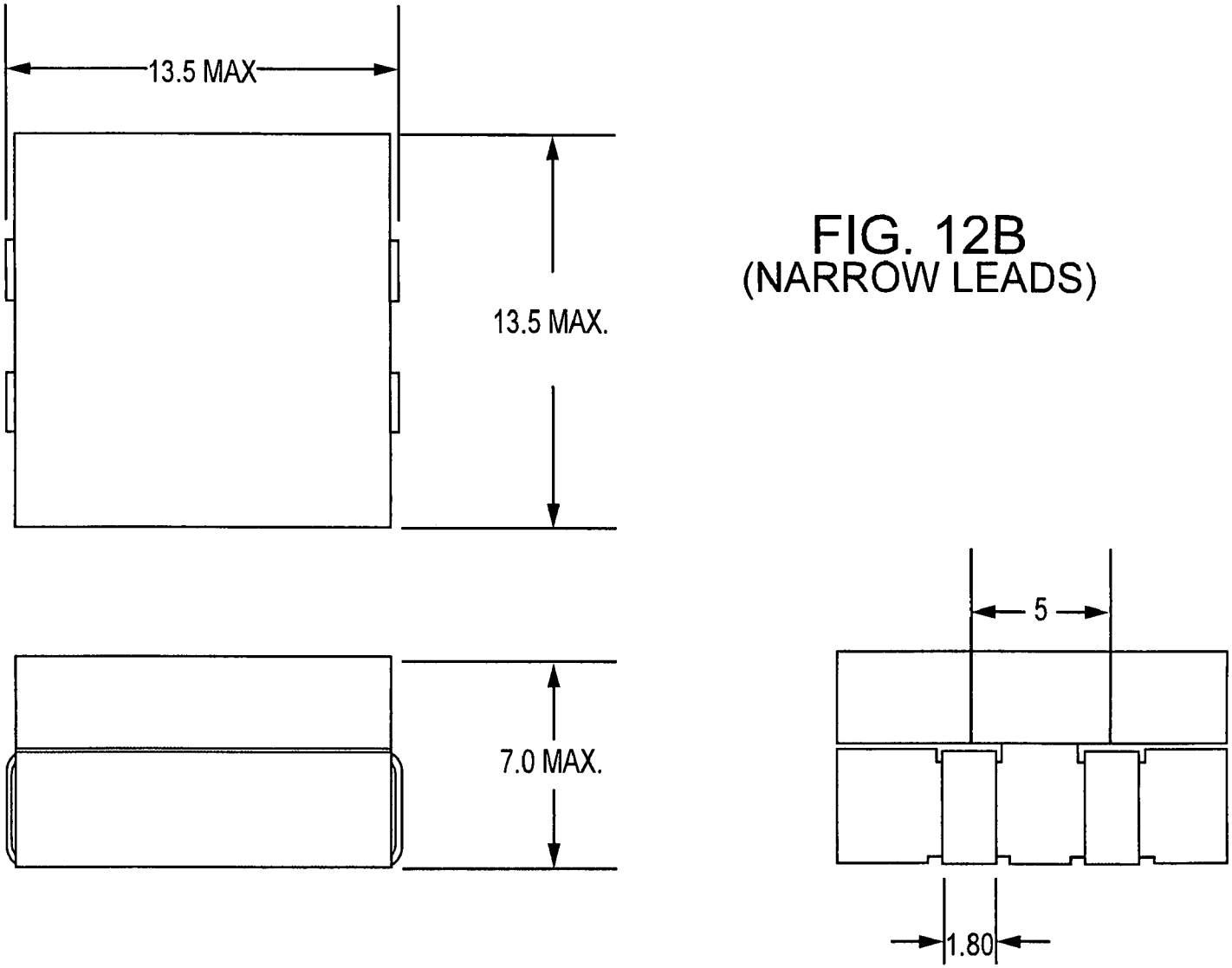

FIGS. 12*a* and 12*b* illustrate still another embodiment of the inductive device 1200 of the invention, having a wider center riser 1206 and narrower windings 1208.

It will be appreciated that the electrical configuration of the various inductive (or transformative) components of each of the foregoing devices 100-1200 can assume literally any arrangement, including for example two or more inductors in parallel, two or more inductors in series, combinations of series and parallel arrangements, etc. For example, in the context of FIG. 1, the four components L1-L4 can be arranged with L1-L4 in electrical series, L1 and L2 in parallel with one another (and in series with paralleled L3-L4), etc. Furthermore, one or more external components can be interposed electrically between the components, such as for example where L1 and L2 are placed in series with a parallel external capacitor, etc. Also, the components of multiple different inductive devices can be intermixed electrically, such as where $L1_a$ is placed in series with $L1_b$ (a and b representing different devices), etc. Myriad such combinations will be appreciated by those of ordinary skill.

Method of Manufacture

An exemplary embodiment of the method for manufacturing the present invention is now described in detail.

It will be recognized that while the following description is cast in terms of the device 100 of FIG. 1, the method is generally applicable to the various other configurations and embodiments of inductive device disclosed herein with proper adaptation, such adaptation being within the possession of those of ordinary skill in the electrical device manufacturing field.

In a first step of the method, one or more cores are provided. The cores may be obtained by purchasing them from an external entity or can involve fabricating the cores directly. The core 102 of the exemplary inductor described above is preferably formed from a magnetically permeable material using any number of well understood processes such as pressing or sintering. The core may be optionally coated with a layer of polymer insulation (e.g., Parylene) or other material, so as to protect the windings from damage or abrasion. This coating may be particularly useful when using very fine gauge windings or windings with very thin film coatings that are easily abraded during the winding process. The core is produced to have specified material-dependent magnetic flux properties, cross-sectional shape, leg dimensions, center core geometry, etc.

As noted above, the core 100 may also be cut or otherwise machined from a ferrite block, with the selected number (e.g., 2 or 4) of legs. Hence, a generic core blank can be used if desired.

Next, one or more windings are provided. The windings are preferably copper-based and substantially flat in profile as discussed above (see FIG. 1*a*), although other types of conductors may be used.

Where uniform inductances are desired, each of the windings are made as identical as possible. Alternatively, where different inductance values or other properties are desired, the windings may be heterogeneous in shape, thickness, length, and/or constituent material.

The windings are then positioned onto the selected locations on each leg of the core, and deformed (e.g., bent) into place such that each winding is retrained on the core, and also has a contact portion adapted for surface mounting to a PCB or other device. The windings may also be optionally bonded to the core 102 using an adhesive or other bonding process.

Lastly, the cap element 114 is disposed onto the device and bonded thereto (whether via adhesive, external frictional clip, etc.), thereby completing the device assembly.

It will be recognized that while certain aspects of the invention are described in terms of a specific sequence of steps of a method, these descriptions are only illustrative of the broader methods of the invention, and may be modified as required by the particular application. Certain steps may be rendered unnecessary or optional under certain circumstances. Additionally, certain steps or functionality may be added to the disclosed embodiments, or the order of performance of two or more steps permuted. All such variations are considered to be encompassed within the invention disclosed and claimed herein.

Furthermore, the techniques and apparatus described in co-owned and co-pending U.S. Provisional Patent Application No. 60/606,330 filed Aug. 31, 2004 and entitled "Precision inductive devices and methods", incorporated herein by reference in its entirety, may be used consistent with the present invention. For example, where gaps are formed between two or more core components (see, e.g., the embodiments of FIGS. 4-8*b* herein), the so-called "residue" gap approach disclosed in the aforementioned provisional application may be used. Other aspects of the 60/606,330 disclosure may also be used with the present invention, as will be recognized by those of ordinary skill in the art provided the present disclosure.

While the above detailed description has shown, described, and pointed out novel features of the invention as applied to various embodiments, it will be understood that various omissions, substitutions, and changes in the form and details of the device or process illustrated may be made by those skilled in the art without departing from the invention. For example, while the invention has been disclosed in terms of a component for telecommunications and networking applications, the inductive device architecture of the present invention could be used in other applications such as specialized power transformers. The foregoing description is of the best mode presently contemplated of carrying out the invention. This description is in no way meant to be limiting, but rather should be taken as illustrative of the general principles of the invention. The scope of the invention should be determined with reference to the claims.

What is claimed is:

1. An inductive device adapted for use in applications requiring a plurality of inductances, comprising:

a magnetically permeable core base element having a plurality of substantially opposed legs each adapted to receive at least one winding thereon, said core base element having:

a substantially planar first surface;

at least one vertical riser disposed distally on each of said substantially opposed legs, said at least one vertical riser comprising an interface element comprising a stepped profile, said stepped profile comprising at least two steps; and a central riser disposed substantially between said vertical risers;

a plurality of conductive windings each disposed substantially around said plurality of opposed legs; and a magnetically permeable core cap element disposed on at least a top one of said at least two steps and configured to magnetically interface with at least said interface element of said vertical risers wherein said plurality of conductive windings are disposed away from said interface element of said vertical risers.

2. The inductive device of claim 1, wherein said magnetic interfaces between said core cap and said vertical risers comprise gaps.

3. The inductive device of claim 2, wherein said gaps include an interposed material.

4. The inductive device of claim 1, wherein each of said plurality of conductive windings comprises a single turn.

5. T1he inductive device of claim 4, wherein said single turn comprises a substantially C-shaped form having a gap, said gap communicating with said first surface.

6. The inductive device of claim 2, wherein said cap element communicates substantially with said central riser, and wherein the height of said riser is set relative to the height of said vertical risers so as to make said gaps a desired width.

7. The inductive device of claim 1, wherein said device is adapted for surface mounting to a printed circuit board.

8. An inductive device comprising:

a core base element having a plurality of legs each adapted to receive at least one winding;

at least one vertical riser disposed distally on each of said plurality of legs, each of said at least one vertical risers comprising a stepped profile;

a central riser;

a plurality of surface mountable conductive windings each disposed substantially around individual ones of said plurality of legs; and a core cap disposed on a top surface of said stepped profile and forming at least one gap between said core cap and said stepped profile wherein said plurality surface mountable conductive windings are disposed substantially away from said stepped profile.

9. The device of claim 8, wherein said plurality of legs comprises at least two legs disposed on said base element in a substantially opposed orientation.

10. The device of claim 9, wherein said base element has a substantially planar bottom surface adapted for surface mounting to an external device.

11. The device of claim 10, wherein said cap element has a substantially planar top surface.

12. The device of claim 9, wherein said legs and their associated windings each comprise an inductance.

13. The device of claim 12, wherein said inductances are purposely made as identical as possible.

14. The device of claim 8, wherein said legs each have a riser portion, said riser portion forming said at least one gap with said cap.

15. A method of providing substantially equal inductances for use in a circuit, comprising:

providing a core base element having a plurality of leg portions each adapted to receive at least one winding, said core base element further comprising a plurality of vertical risers, said plurality of vertical risers disposed symmetrically about a central axis of said core base element and disposed substantially orthogonal with respect to said plurality of leg portions;

providing a plurality of conductive windings;

providing a core cap adapted for mating with said core base element;

mating said cap to said core base element, said mating and forming at least one gap between said core base element and said cap; and disposing each of said windings substantially around each of said plurality of leg portions of said core element and away from the mating interface of said core cap and said core base element;

wherein said core base element, windings and cap cooperate to form a plurality of substantially equal inductances.

16. The method of claim 15, wherein said act of providing a core base element comprises providing a core base element that has a substantially planar base plane portion and a plurality of at least partly stepped vertical risers, said vertical risers being punctuated by said portions receiving said windings.

17. A method of manufacturing an inductive device having a plurality of substantially equal inductances, comprising:

providing a core base element having a plurality of substantially symmetric portions each adapted to receive at least one winding and further comprising a plurality of risers protruding perpendicular from said plurality of substantially symmetric portions;

providing a plurality of conductive windings;

disposing each of said windings substantially around each one of said plurality of substantially symmetric portions of said core element;

providing a core cap adapted for mating with said core base element; and mating said cap to said core base element, said mating and forming at least one gap between said core base element and said cap;

wherein said core base element, windings and cap cooperate to form a plurality of substantially equal inductances; and wherein said plurality of conductive windings are disposed substantially away from said at least one gap between said core base element and cap.

18. A space-efficient surface mountable inductive device adapted for use in applications requiring a plurality of substantially equal inductances, comprising:

a magnetically permeable core base element having a plurality of substantially juxtaposed portions each adapted to receive at least one winding thereon, said core base element having:

a substantially planar first surface; and a plurality of substantially juxtaposed vertical risers disposed orthogonally on said plurality of substantially juxtaposed leg portions, each of said plurality of substantially juxtaposed vertical risers comprising a plurality of steps;

a plurality of self-leading conductive windings each disposed substantially around at least one of said leg portions of said core element; and a magnetically permeable core cap element disposed on one of said plurality of steps and configured to magnetically interface with a gap formed with at least another one of said plurality of steps.

19. An inductive device adapted for use in applications requiring a plurality of inductances, comprising:

a magnetically permeable core base element having a plurality of substantially opposed legs each adapted to receive at least one winding thereon and each being substantially symmetric with another one of said plurality of legs, said core base element having:

a substantially planar first surface;

at least one vertical riser disposed distally on each of said substantially opposed legs, said at least one vertical riser comprising a substantially stepped profile on a top surface thereof; and a central riser disposed substantially between said vertical risers;

a plurality of self-leading conductive windings each disposed substantially around a leg of said core and disposed substantially away from said substantially stepped profile; and a magnetically permeable core cap element disposed proximate to said core base element and configured to magnetically interface with at least a portion of a top surface of each of said vertical risers.

20. An inductive device adapted for use in applications requiring a plurality of inductances, comprising:

a magnetically permeable core base element having a plurality of substantially opposed legs each adapted to receive at least one winding thereon, said core base element having:

a substantially planar first surface;

at least one vertical riser disposed distally on each of said substantially opposed legs; and a central riser disposed substantially between said vertical risers;

a plurality of conductive windings each disposed substantially around each one of said plurality of substantially opposed legs of said core; and a magnetically permeable core cap element disposed proximate to said central and vertical risers substantially away from said substantially planar first surface;

wherein said plurality of conductive windings are disposed substantially distant from an interface between said magnetically permeable core cap element and said core base element.

21. An inductive device, comprising:

a magnetically permeable core base element having a plurality of substantially opposed legs each adapted to receive at least one winding thereon, said core base element having:

a substantially planar first surface;

at least one vertical riser disposed distally on each of said substantially opposed legs, said at least one vertical riser comprising a stepped interface; and a central riser disposed substantially between said vertical risers;

a first conductive winding disposed about a first one of said plurality of substantially opposed legs forming a first inductor and substantially distant from said stepped interface;

a second conductive winding disposed about a second one of said plurality of substantially opposed legs forming a second inductor and substantially distant from said stepped interface; and a magnetically permeable core cap element disposed proximate to said magnetically permeable core base element at said stepped interface of said at least vertical riser;

wherein the respective magnetic fluxes induced in said central riser by said first and second inductors are in a substantially opposite directions.

22. An inductive device, comprising:

a magnetically permeable core base element, comprising:

at least two vertical elements, said at least two vertical elements each comprising at a first end an interface element having a substantially stepped profile comprising a first and a second step, and a second end disposed distally from said interface element;

a plurality of opposed orthogonal elements, said plurality of opposed orthogonal elements physically interfacing with respective ones of said at least two vertical elements at said second end; and a central vertical element disposed substantially between and parallel to said at least two vertical elements;

a plurality of conductive windings each disposed substantially around said plurality of orthogonal elements of said core base element and substantially distant from said stepped profile; and a magnetically permeable core cap element disposed on said first step and forming a gap with said second step and configured to magnetically interface with at least said interface element of said at least two vertical elements.

* * * * *